US005864293A

United States Patent [19]

Lewiner et al.

[11] Patent Number: 5,864,293

[45] Date of Patent: Jan. 26, 1999

[54] OPTICAL SMOKE DETECTORS

[75] Inventors: Jacques Lewiner, Saint Cloud; Eugeniusz Smycz, Saint-Michel-Sur-Orge, both of France

[73] Assignee: Orwin, St. Michel Sur Orge, France

[21] Appl. No.: 776,369

[22] PCT Filed: Jul. 27, 1995

[86] PCT No.: PCT/FR95/01014

§ 371 Date: Apr. 14, 1997

§ 102(e) Date: Apr. 14, 1997

[87] PCT Pub. No.: WO96/04627

PCT Pub. Date: Feb. 15, 1996

[30] Foreign Application Priority Data

Jul. 29, 1994 [FR] France ..... 94 09473

[51] Int. Cl.[6] ..... G08B 17/10

[52] U.S. Cl. ..... 340/630; 340/578; 340/584; 250/574; 356/438

[58] Field of Search ..... 340/577, 578, 340/584, 628, 630; 250/574, 575; 356/436, 437, 438, 439

[56] References Cited

U.S. PATENT DOCUMENTS

| | | | |
|---|---|---|---|
| 3,946,241 | 3/1976 | Malinowski | 340/630 |
| 4,075,499 | 2/1978 | Malonowski | 340/630 |
| 4,163,969 | 8/1979 | Enemark | 340/630 |
| 4,225,860 | 9/1980 | Conforti | 340/629 |
| 4,254,414 | 3/1981 | Street et al. | 340/627 |
| 5,008,559 | 4/1991 | Beyersdorf | 340/630 |
| 5,422,629 | 6/1995 | Minnis | 340/630 |

FOREIGN PATENT DOCUMENTS 011 205 A1 5/1980 European Pat. Off. .

OTHER PUBLICATIONS

French Search Report, dated Apr. 5, 1995, French Appl. No. FR9409473.

International Search Report, dated Oct. 20, 1995, International Appl. No. PCT/FR95/01014.

*Primary Examiner*—Daniel J. Wu

*Attorney, Agent, or Firm*—Marshall, O'Toole, Gerstein, Murray & Borun

[57] ABSTRACT

The device for detecting the presence of smoke includes a dark chamber which receives the smoke to be detected, a source suitable for emitting into said chamber a light pencil made up of short duration pulses spaced apart from one another by identical much longer periods, a detector suitable for generating response signals associated with the smoke reflecting part of the successive light pulses, and means for comparing said signals with a threshold and for triggering an alarm in the event of said threshold being exceeded by a plurality of said successive signals. The device further comprises means for automatically increasing the frequency at which said pulses are emitted from the first occasion on which a signal exceeding said threshold is detected, the alarm then possibly being triggered, as a function of the signals generated by the detector in response to a plurality of successive pulses emitted at the higher frequency.

4 Claims, 1 Drawing Sheet

OPTICAL SMOKE DETECTORS

FIELD OF THE INVENTION

The invention relates to devices for detecting the presence of smoke, in particular for monitoring premises against fire risks, and for triggering a fire alarm automatically, in particular an audible alarm, whenever the detected smoke density exceeds a predetermined threshold.

BACKGROUND OF THE INVENTION

Amongst such detectors, the invention relates more particularly to those which use an appropriate detector to take advantage of an optical effect that relies on a relatively intense light pencil being reflected by some of the particles making up the smoke to be monitored, which smoke passes through a dark chamber containing said detector.

Given the intensity of the light pencil, if it were to be emitted continuously, the resulting electricity consumption of the device would be very large.

To avoid that drawback, proposals have already been made to emit said pencil in the form of light pulses of short duration t that are spaced apart from one another by identical much longer periods T, where the durations t are of the order or 1 millisecond or 100 microseconds, for example, while the periods T are of the order of 5 seconds to 10 seconds, detection then being performed on the basis of electrical response signals generated by the detector solely during the durations t, with the values of said signals being compared in turn with a value representing the above threshold so as to trigger the alarm if the threshold is exceeded.

To create said pulses of duration t, it is preferable to act as follows: a capacitor is charged during the periods T by means of a small electrical current, and at the end of each of said periods the capacitor is discharged during times t, and the current pulses of duration t generated in this way are applied to a light source, which current pulses give rise to light pulses of the same duration and forming the light pencil.

In general, in order to avoid untimely triggering of the alarm, as could be set off by the detector being suddenly illuminated, e.g. due to the device being scanned by an intense light beam itself created directly from a hand-held flashlight or indirectly by reflection of the sun on a glossy surface moving in view of the device, an alarm indicating a risk of fire is triggered only after verifying that the previously programmed trigger threshold has continued to be exceeded for a plurality of successive light pulses (see document EP-A-0 011 205).

If the spacing between said successive light pulses reaches or exceeds 5 or 10 seconds, the duration of such a safety check can run to half a minute or more, and that is prohibitive.

OBJECTS AND SUMMARY OF THE INVENTION

A particular object of the invention is to eliminate that drawback while continuing to benefit from the great saving due to forming the light pencil that is used for detection purposes as short pulses that are spaced apart in time.

To this end, according to the invention, a smoke detector device of the kind in question further comprises means for forming the checking incident light pencil using current pulses that are likewise spaced apart in time, and the means further include means for automatically increasing the frequency at which said pulses are emitted on the first occasion it is detected that the smoke density to be checked has exceeded the predetermined threshold; an alarm then possibly being triggered as a function of the signals generated by the detector in response to a plurality of successive pulses emitted at a higher frequency, said means then being returned to normal if, and only if, examination of said signals indicates that the situation has returned to normal.

In preferred embodiments, use is also made of one or more of the following dispositions:

- the means for emitting the light pulses constituting the incident pencil comprise a DC source and a light source connected across the terminals of the DC source via at least one electronic switch and the means for increasing the frequency of the pulses in the event of the predetermined threshold being exceeded by the response signal from the detector comprise an amplifier for amplifying said response signal, an analog-to-digital converter, a microprocessor including the threshold recorded in a suitable memory, and a circuit associated with the microprocessor and optionally integrated therein, suitable for increasing the frequency at which the switch is actuated as soon as the threshold is exceeded by the response signal and so long as it continues to exceed the threshold;
- the microprocessor includes means for detecting the direction of variation of the amplitudes of the response signals from the detector corresponding to successive pauses emitted at the increased frequency, in particular by calculating a derivative, and means for triggering an alarm if, and only if, said direction is increasing;
- the assembly constituted by the microprocessor and the circuit for controlling the frequency at which the pulses constituting the incident light pencil are emitted is organized in such a manner that the amplitudes of those pulses which are emitted at the higher frequency increase over time; and
- the assembly comprising the microprocessor and the circuit for controlling the frequency at which the pulses constituting the incident light pencil are emitted is organized in such a manner that the width and/or the amplitudes of the pulses emitted at the higher frequency are greater than of the pulses previously emitted at the normal frequency.

In addition to the above dispositions, the invention includes certain other dispositions that are preferably used together therewith and explained in greater detail below.

BRIEF DESCRIPTION OF THE DRAWING

There follows a description of various preferred embodiments of the invention given with reference to the accompanying drawing, and in a manner that is naturally not limiting.

MORE DETAILED DESCRIPTION

In conventional manner, the detector comprises a housing 1 mounted on a base 2 and pierced by windows 3 suitable for passing smoke F that is to be checked.

The windows 3 are associated with baffles (not shown) serving to keep out as much light as possible from the housing 1, thereby forming a dark chamber within the housing.

The housing contains a light source L suitable for emitting a light pencil P into the dark chamber, and a detector D placed in said chamber in a zone that is in the shadow relative to the source L.

If no smoke is present in the housing when the incident pencil P is emitted, then the light is substantially not reflected to the detector D so the response therefrom is very low, or even practically zero.

In contrast, if the housing contains smoke, then the particles X constituting the smoke constitute small mirrors suitable for reflecting light: as a result some of the rays reflected in this way reach the detector D, and the intensity of the response therefrom increases with increasing density of the smoke under consideration.

Figure 4:
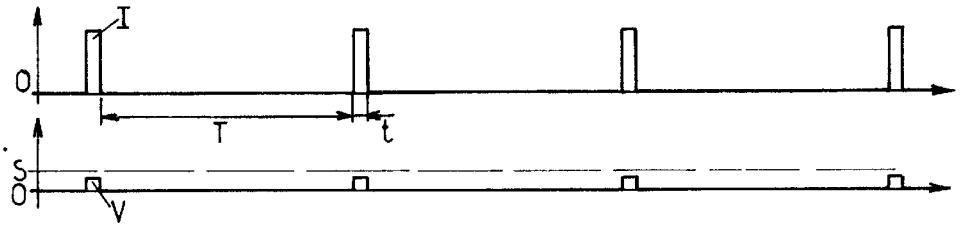
FIGS. 4, 5, and 6 are waveform diagrams each comprising an upper portion showing incident light pulses and a lower portion showing the response signals from the detector for three respective different situations.

As mentioned above, the incident light pencil P is not emitted continuously, but in the form of pulses I (FIG. 4) of relatively short duration t, in particular of the order of 100 microseconds to 1 millisecond, with the periods T that elapse between successive pulses I themselves being relatively long, and in particular of the order of 5 seconds to 10 seconds.

Figure 3:
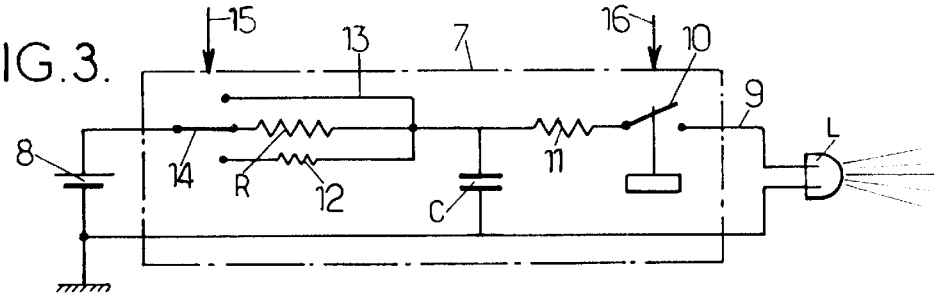
FIG. 3 is a more detailed diagram of another component of the device, namely its circuit for controlling the frequency at which light pulses are emitted.

With such duration ratios, it is possible to use an appropriate resistance and capacitance (RC) circuit (FIG. 3) with a switch to generate one-amp current pulses by successively charging and discharging the capacitor which is connected across the terminals of the light source L to be excited, the mean charging current being only 100 microamps or less.

This achieves very considerable reduction in the electricity consumption of the detectors in question, the reduction factor generally exceeding 5,000.

As also mentioned above, in order to avoid any untimely alarms, it is appropriate on each occasion that the threshold is found to have been exceeded on the basis of a single incident light pulse, to confirm the situation over a plurality of subsequent pulses, and such verification can turn out to be too lengthy in practice: saving even 1 minute or only half a minute can be extremely precious in extinguishing the beginning of a fire.

The invention makes it possible to benefit both from the considerable saving due to emitting light in the form of short pulses repeated at a relatively slow rate, and the reliability of a response given only after multiple verifications, while nevertheless keeping the time required to obtain said response very small, possibly down to about 1 second.

To this end, according to the invention, the frequency at which light pulses are emitted is automatically increased as soon as it has been observed that the threshold has been exceeded abnormally as detected on the basis of an incident pulse emitted at the normal low frequency.

The above-mentioned multiple verification is the performed on the basis of pulses emitted at the higher frequency: this verification is thus much quicker than before, and can act much faster to avoid uncertainty as to the origin of the abnormality; the response of the detector device is thus much quicker without the reliability of said response being reduced in any way.

Figure 1:
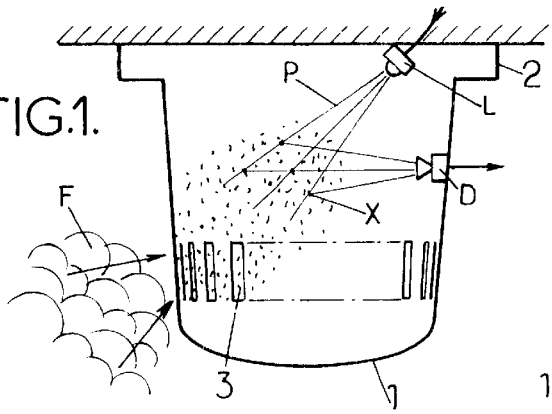
FIG. 1 of the drawing is highly diagrammatic, showing the component in a detector device implemented in accordance with the invention in which optical detection proper takes place.
Figure 2:
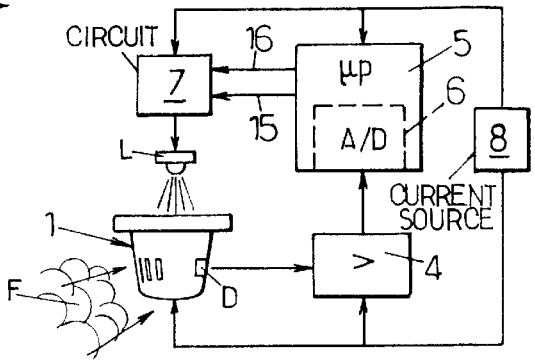
FIG. 2 is a simplified block diagram of the detector device of the invention.

FIG. 2 is a diagram of a circuit enabling such a result to be obtained.

The circuit comprises:

an amplifier 4 receiving the output from the detector D;

an assembly comprising a microprocessor 5 and an input analog-to-digital converter 6, which assembly receives the output from the amplifier 4 and includes, stored in a memory, the threshold S which, when exceeded by the signal output by the detector D as amplified by the amplifier 4, indicates that the density of smoke F is dangerous;

a circuit 7 receiving the output from the assembly 5, 6 and suitable for controlling the frequency at which light pulses are emitted by the source L, which circuit may be implemented at least in part in said assembly 5, 6; and an electrical current source 8 powering the various above components.

The circuit 7 controlling the frequency at which pulses I are emitted itself comprises (see FIG. 3) and in conventional manner:

the above-mentioned capacitor C connected across the terminals of the current source 8 via the above-mentioned resistor R so as to be charged very slowly by said source, at a speed and to a level that depend on the resistance of said resistor; and a circuit 9 connecting the light source L to the terminals of the capacitor C via an electronic switch 10 and a resistor 11.

The circuit 7 in this case further includes:

at least one other resistor 12 of resistance lower than that of the resistor R connected in parallel with the resistor R, said other resistor 12 optionally being constituted merely by a low-resistance conductor 13, with one or other of the parallel-connected resistors (R, 12, 13, . . . ) being selected at will by an electronic switch 14; and electrical connections symbolized by arrows 15 and 16 and associated with suitable control means for transforming instructions generated by the microprocessor 5 into corresponding commands, either for the switch 14 on its own, or for said switch together with the switch 10, assuming that the switch 10 is not organized to close automatically for a short period of time whenever the charge on the capacitor C exceeds a predetermined threshold.

The assembly operates as follows.

Under normal circumstances, i.e. when there is no smoke F in the housing 1, the light source L emits light pulses I that are spaced apart by identical and relatively long periods T (FIG. 4) as generated by the capacitor C discharging automatically over time, and then being charged continuously and slowly from the current source 8.

These light pulses give rise to voltage signals V (FIG. 4) of very small amplitude at the output of the detector D: this amplitude remains below the amplitude of a threshold S recorded in the microprocessor 5 (account naturally being taken of the amplification provided by the amplifier 4) such that the microprocessor does not generate on its outputs 15 and 16 any command signal suitable for interfering with the normal succession of monitoring cycles.

Figure 5:
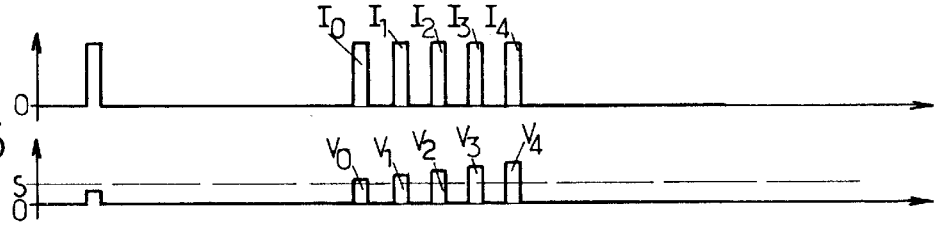

As soon as a sufficiently dense puff of smoke F has penetrated into the housing 1, a light pulse referenced $I_0$ as emitted by the source L gives rise to the detector D generating a voltage pulse $V_0$ (FIG. 5), because of some of the light rays making up said pulse being reflected on particles X of the smoke.

If the voltage $V_0$ exceeds the threshold S, than the microprocessor immediately applies an order via its outputs 15 and 16 that increases the frequency with which light pulses are emitted, with said frequency being multiplied, for example, by a factor of about 10.

This increase is obtained by changing the position of the switch 14 so as to replace the resistor R in the RC circuit with one of the lower resistance resistors 12, 13, etc.

On each subsequent pulse $I_1$, $I_2$, $I_3$, . . . , that then takes place at a higher frequency following the incident pulse $I_0$, there corresponds a response voltage $V_1$, $V_2$, $V_3$, . . . .

It is essential to examine the values of these responses in order to determine whether the crossing of the threshold as observed during emission of incident pulse $I_0$ was short-lived, and would have given rise to a false alarm had it been taken into consideration on its own, or whether, on the contrary, it was indeed representative of the beginning of a fire that needs to cause an alarm to be issued.

In the first case, said successive values will decrease and return quickly below the threshold S: under such circumstances, the microprocessor 5 issues instructions to return the switch 14 to its initial, slow-monitoring position.

In the second case, the successive values in question will increase: that confirms the danger as initially detected, and the microprocessor is organized then to excite an alarm of any suitable nature, in particular an audible alarm.

The direction in which the above successive values vary can be determined by calculating a derivative in the microprocessor.

If the successive values $V_1$, $V_2$, . . . remain constant, doubt may subsist for longer.

Various solutions can then be considered for avoiding such doubt.

In a first solution, the decision to trigger the alarm or to return to the monitoring state is deferred until it is detected that the amplitudes of the responses $V_n$ vary in one direction or the other.

In another solution, the alarm is automatically triggered at the end of some minimum duration $T_a$ which may itself be of a value that increases with decreasing difference between the constant value of the response pulses $V_n$ and the threshold S.

In yet another variant for refining the overall response, the incident pulses $I'_1$, $I'_2$, . . . are themselves given increasing values: experience shows that the resulting variation in the amplitudes of the corresponding response signals $V'_1$, $V'_2$, . . . , is greater than the variation in the amplitudes of the incident pulses.

Figure 6:
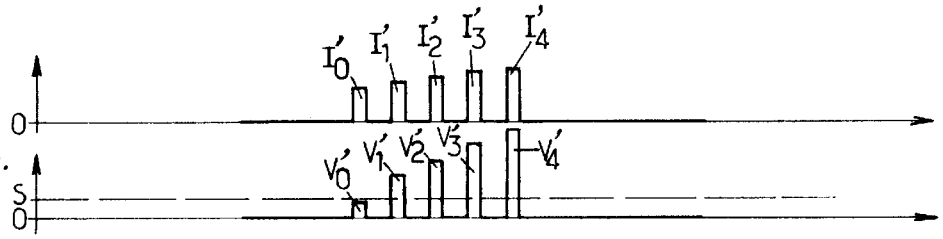

This is shown in FIG. 6.

For the same purpose, it would also be possible to give the durations and/or the amplitudes of the individual pulses values that remain constant, but that are greater than those of the pulses I as emitted at the low rate during each normal monitoring period.

Each of the two above-described switches 10 and 14 is advantageously constituted by a transistor or a semiconductor having three electrodes, with the control electrode being connected to the corresponding output (16 or 15) of the microprocessor 5, said transistors or the like possibly being integrated in the microprocessor, together with the resistors (11, 12, R) with which they are associated.

That structure, or better still such integration, makes it possible to act in particularly fine manner on the values of the frequencies and/or the amplitudes of the pulses $I_1$, $I_2$, . . . that are to be generated.

Similarly, to determine accurately the instants at which the capacitor C discharges, it is advantageous to provide a circuit that is suitable for measuring the real voltage at all times across the terminals of said capacitor, which circuit may itself form a portion of the assembly 5, 6: this voltage measurement makes it possible to avoid errors that could result from aging of the circuits.

Regardless of the embodiment adopted, it follows that an optical smoke detector device is obtained whose structure and operation are made sufficiently clear from the description above.

Compared with presently known devices, this device presents numerous advantages, and in particular that of a response that is fast and reliable, while suffering from practically no increase in mean electricity consumption which remains extremely low.

Naturally, and as can be seen from the above, the invention is not limited in any way to the particular applications and embodiments envisaged more specifically; on the contrary, it extends to any variant, in particular variants in which a portion of the above-described microprocessor 5 is replaced by a comparator (not shown) having one input receiving the output from the amplifier 4 and another input receiving an electrical signal representative of the threshold S, the output from the comparator then being applied to the circuit 7, preferably via a unit constituted by a microprocessor and by an analog-to-digital converter, which unit can perform signal processing in particularly simple and effective manner.

We claim:

1. A device for detecting the presence of smoke the device comprising a dark chamber that receives the smoke to be detected, a source suitable for emitting into said chamber a light pencil formed by short duration pulses that are spaced apart by identical much longer periods, a detector suitable for generating response signals associated with the successive light pulses being reflected partially by certain particles making up the smoke contained in the chamber, and means for comparing said response signals with a predetermined threshold and for triggering an alarm in the event of such threshold being exceeded by a plurality of said successive response signals, the device further comprising means for automatically increasing the frequency at which said pulses are emitted on the first occasion it is detected that the smoke density has exceeded the predetermined threshold, an alarm then being triggered as a function of the signals generated by the detector in response to a plurality of successive pulses emitted at a higher frequency, said means then being returned to normal if, and only if, examination of said signals indicates that the situation has returned to normal, in which the means for emitting the light pulses constituting the incident pencil comprise a DC source and a light source connected across the terminals of the DC source via at least one electronic switch and in which the means for increasing the frequency of the pulses in the event of the predetermined threshold being exceeded by the response signal from the detector comprise an amplifier for amplifying said response signal, an analog-to-digital converter, a microprocessor including the threshold recorded in a suitable memory, and a circuit associated with the microprocessor and optionally integrated therein, suitable for increasing the frequency at which the switch is actuated as soon as the threshold is exceeded by the response signal and so long as it continues to exceed the threshold.

2. A detector device according to claim 1, in which the microprocessor includes means for detecting the direction of variation of the amplitudes of the response signals from the detector corresponding to successive pulses emitted at the increased frequency, in particular by calculating a derivative, and means for triggering an alarm if, and only if, said direction is increasing.

3. A detector device according to claim 1, in which the assembly constituted by the microprocessor and the circuit for controlling the frequency at which the pulses constituting the incident light pencil are emitted is organized in such a manner that the amplitudes of those pulses which are emitted at the higher frequency increase over time.

4. A detector device according to claim 1, in which the assembly comprising the microprocessor and the circuit for controlling the frequency at which the pulses constituting the incident light pencil are emitted is organized in such a manner that the width and/or the amplitudes of the pulses emitted at the higher frequency are greater than of the pulses which were previously emitted at the normal frequency.

* * * * *